United States Patent [19]

Tedder

[11] 4,363,592

[45] Dec. 14, 1982

[54] TOOL FOR REMOTELY INSTALLING EQUIPMENT THROUGH AN ACCESS OPENING

[75] Inventor: Joseph A. Tedder, East Hartford, Conn.

[73] Assignee: Combustion Engineering, Inc., Windsor, Conn.

[21] Appl. No.: 225,871

[22] Filed: Jan. 19, 1981

[51] Int. Cl.[3] ..... B25J 3/00

[52] U.S. Cl. ..... 414/590; 414/728

[58] Field of Search ..... 414/728, 749–751, 414/4, 909, 589, 590, 222, 225, 569; 165/76

[56] References Cited

U.S. PATENT DOCUMENTS

| | | | |
|---|---|---|---|
| 4,018,344 | 4/1977 | Leshem | 414/751 X |
| 4,193,735 | 3/1980 | Savor et al. | 414/750 X |
| 4,212,583 | 7/1980 | Gebelin | 414/728 |
| 4,303,368 | 12/1981 | Dent et al. | 414/590 |

*Primary Examiner*—Douglas C. Butler
*Assistant Examiner*—Terrance L. Siemens
*Attorney, Agent, or Firm*—Arthur L. Wade

[57] ABSTRACT

A tool is essentially an extensible mechanical arm adapted on one end to support equipment in a hostile environment while the arm is manually manipulated from its second end in a benign environment. The arm is pivoted at the entrance to an area containing nuclear radiation with its end projected into the radiation area, and adapted to install and remove equipment.

6 Claims, 5 Drawing Figures

TOOL FOR REMOTELY INSTALLING EQUIPMENT THROUGH AN ACCESS OPENING

TECHNICAL FIELD

Figure 1:
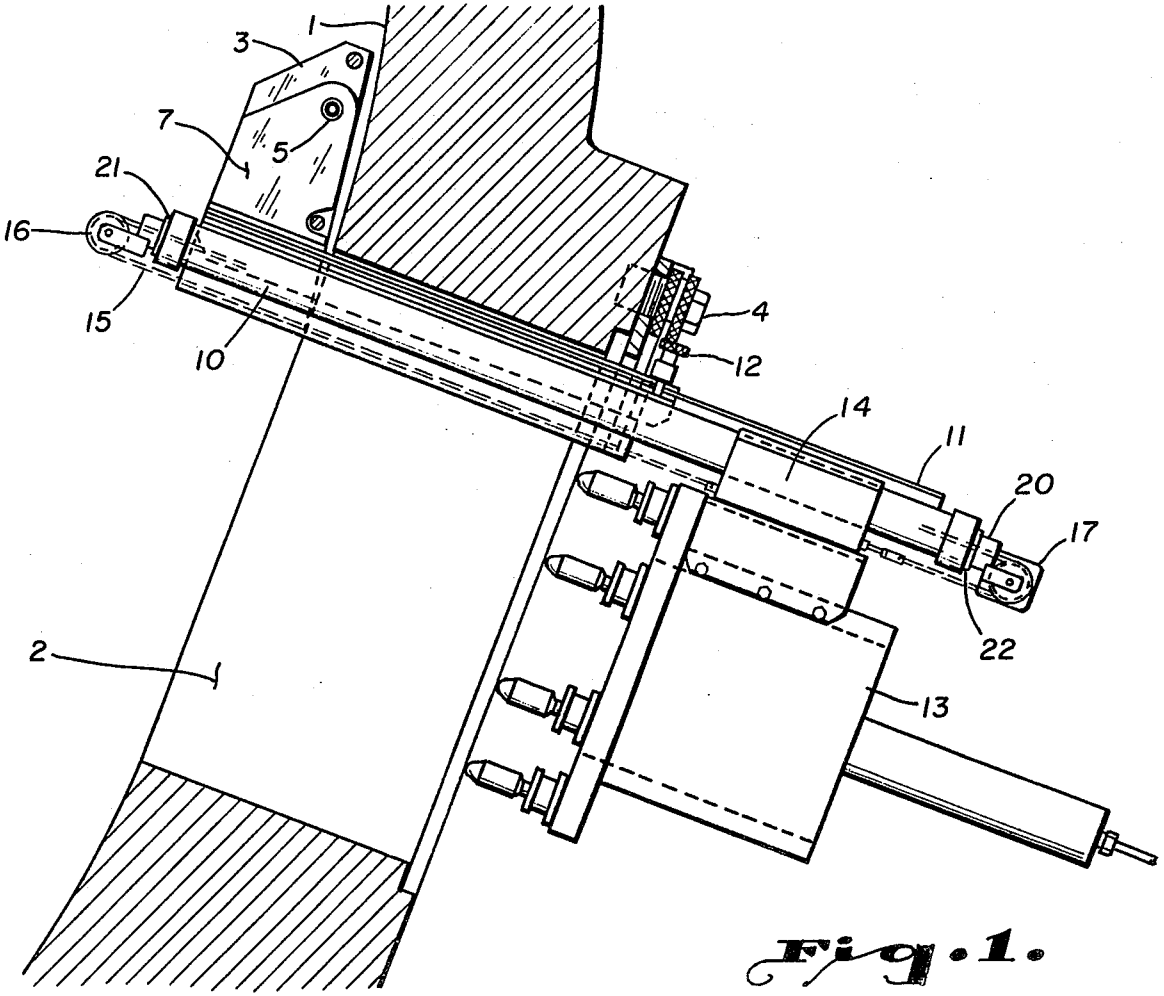

The present invention relates to the remote positioning and removal of equipment in a hostile environment by mechanical extensible structure. More particularly, the invention relates to positioning equipment into a hostile nuclear radiation environment on the end of an elongated mechanical arm manually manipulated from one end.

BACKGROUND ART

The "finger walker" is a fascinatingly complex device remotely operated to cling to the overhead tube sheet of a nuclear boiler. Personnel, operating the finger walker from a safe distance outside the boiler shell, "walk" the support structure over the surface of the tube sheet to enable inspection equipment mounted on the structure to ferret out suspicious tubes. Locating defective tubes, remotely operated structure on the finger walker inserts plugs into the tubes where they are welded to block the defective tube from service. This unique technological house pet is disclosed in at least Leshem U.S. Pat. No. 4,018,344 issued Apr. 19, 1977. As evidence of continuing additions and improvements to this structure, reference is made to Savor and Harrison U.S. Pat. No. 4,193,735 issued Mar. 18, 1980.

Although the finger walker clings bat-like to the overhead tube sheets of nuclear boilers, they do not originally fly up to their perch without assistance. It has been common practice for strong young men to squeeze into the boiler shell through an access manway and manually roust the device upward into its initial position. Of course, the strong young men have been subjected to some measure of radiation while within the boiler shell. Naturally, it is desirable to reduce, if not completely obviate, the exposure time of the bodies of this personnel to this hostile environment and thereby protect them from at least the possibility of genetic malformations.

It is highly desirable that the finger walker, and any other equipment terminating its travel in a hostile environment, be mechanically levered into position. Also, it is desirable that such equipment, functioning within the hostile environment, be removed by mechanical arms safely operated by personnel outside in a benign environment.

DISCLOSURE OF THE INVENTION

The present invention contemplates an elongated, extensible assembly of mechancal structures which can be adapted and arranged to be mounted at or near the access opening to a hostile environment. All parts of the assembly are operable by minimum exposure of the bodies of personnel to the hostile environment. Additionally, the invention provides articulation for the assembly from where it is clamped on a fixed base at the boundary between the benign and hostile environments to, first, insert the assembly within the hostile environment, and second, pivot the assembly from its base, and finally, move the positionable equipment along the assembly to its final station within the hostile environment. Finally, the articulation is reversible, securing the equipment within the hostile environment and removing it to the benign environment.

Other objects, advantages and features of this invention will become apparent to one skilled in the art upon consideration of the written specification, appended claims, and attached drawings.

BRIEF DESIGNATION OF THE DRAWINGS

Figure 3:
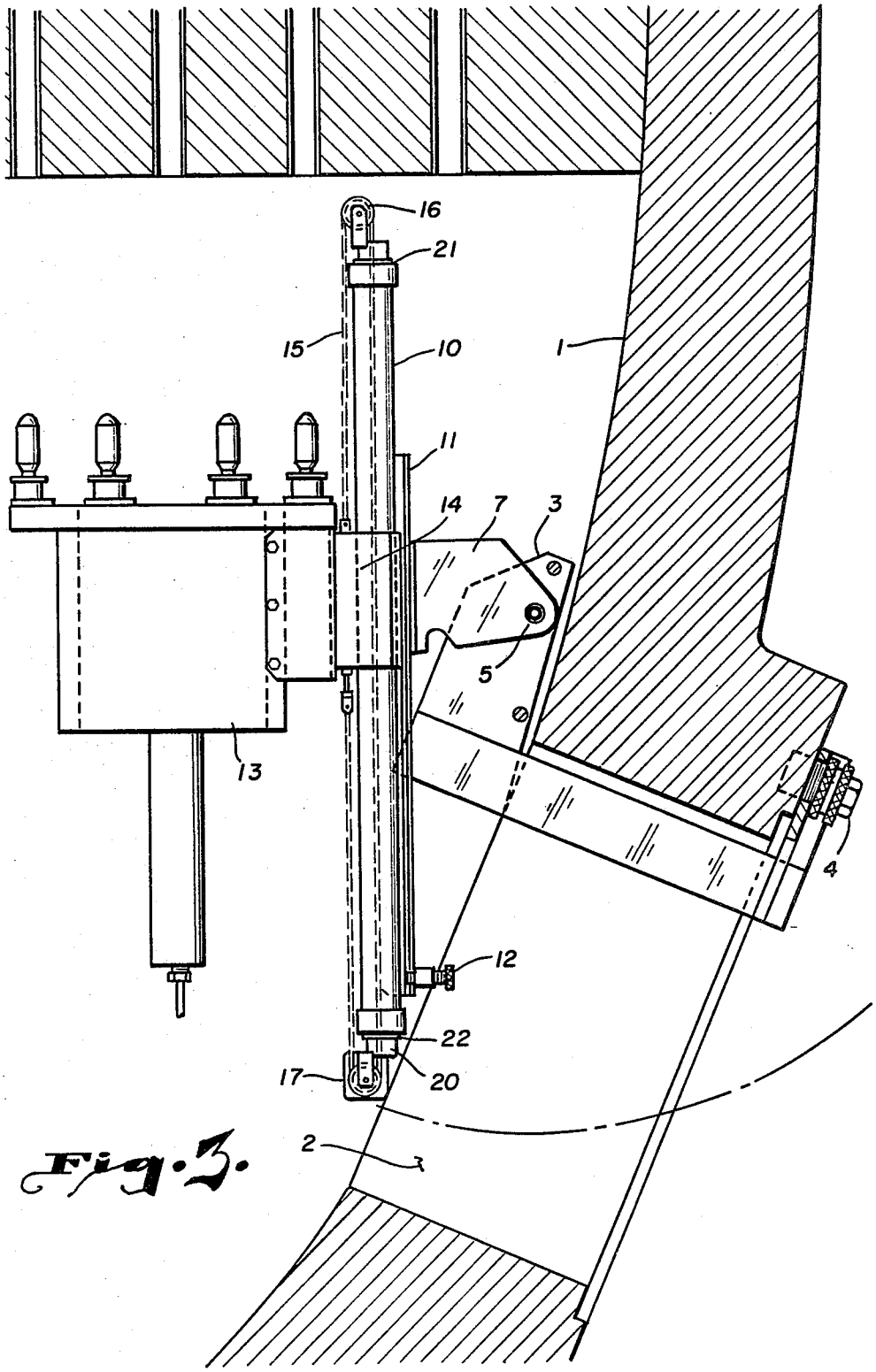
Figure 4:
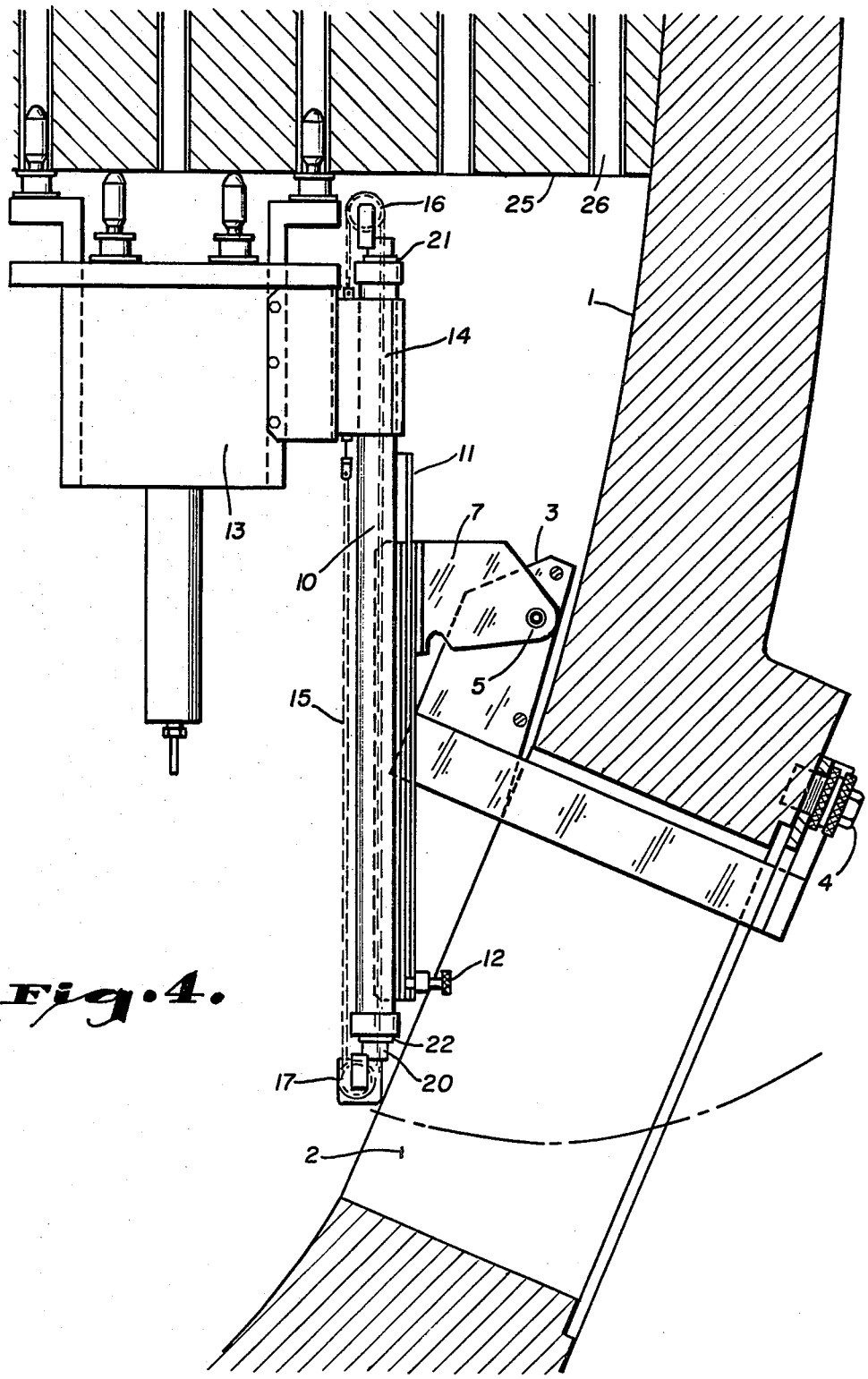
Figure 5:
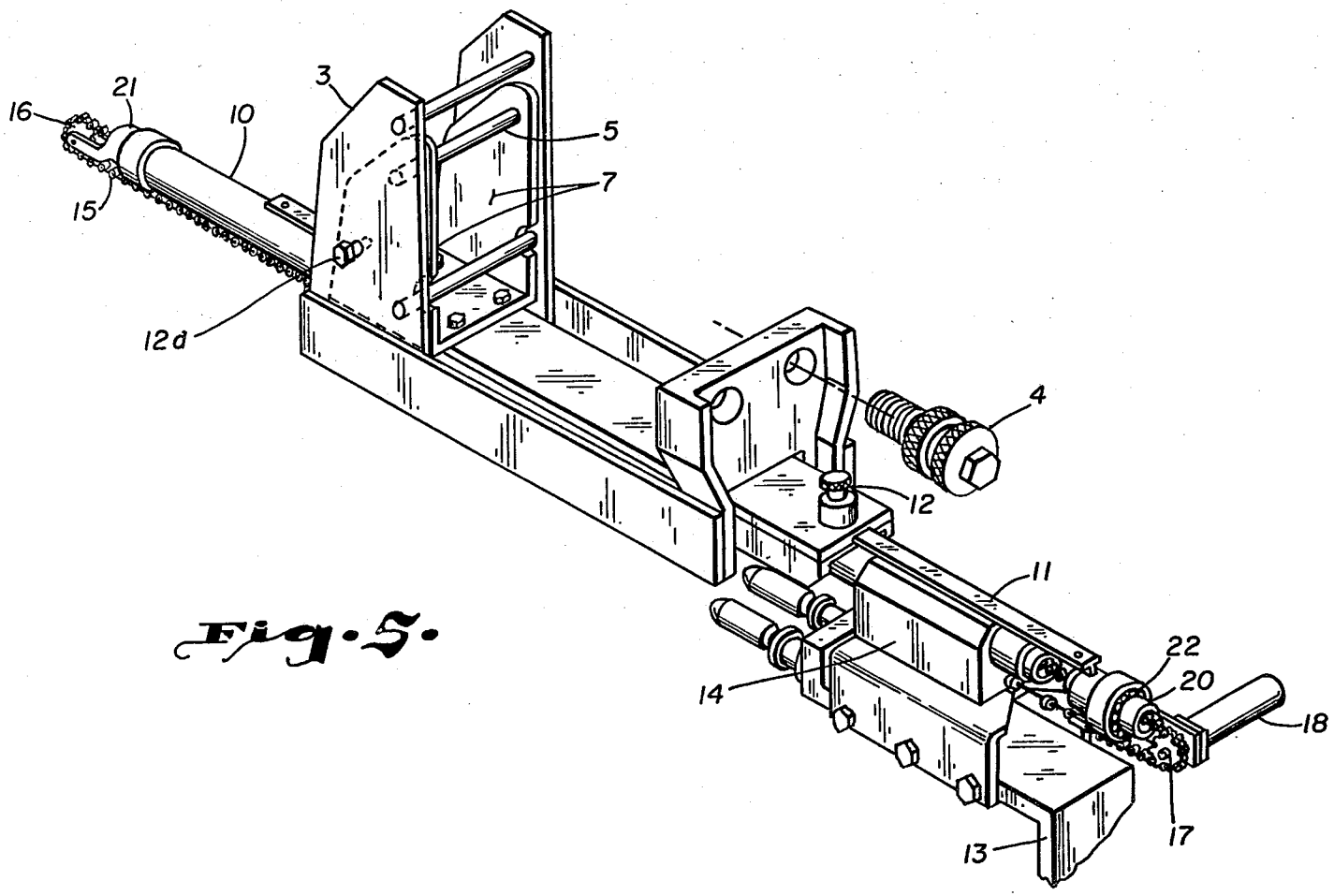

FIGS. 1–4 disclose the articulation of an extension arm assembly embodying the present invention; and FIG. 5 is an exploded isometric of the transfer tube as the center of the basic parts embodying the invention.

BEST MODE FOR CARRYING OUT THE INVENTION

General Organization

Each of FIGS. 1–4 disclose the relationship between the major parts of the extension arm embodying the present invention. Further, the four figures illustrate the sequence within a complete cycle of articulation with which a working piece of equipment is transferred from a benign environment to a predetermined station within a hostile environment.

Figure 2:
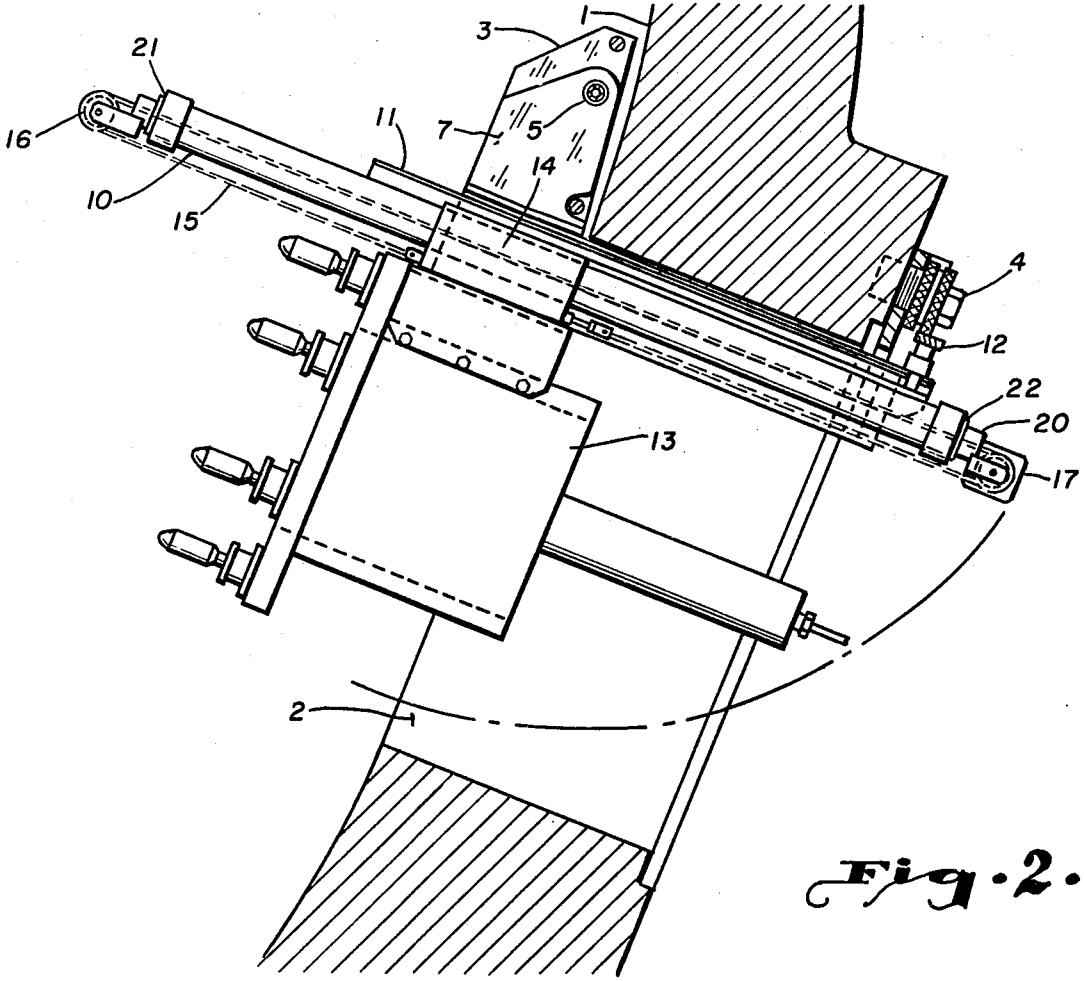

FIG. 1 shows the embodying assembly of the invention clamped firmly to the wall of a vessel containing the hostile environment of nuclear radiation. The assembly extends from the benign environment outside the vessel wall to make it possible to attach a finger walker to the assembly. FIG. 2 discloses the assembly manually articulated forward and the finger walker moved forward far enough to avoid interference with the opening through the wall through which the assembly and finger walker are to be pivoted. FIG. 3 discloses the assembly pivoted into the interior of the vessel preparatory to elevating the finger walker to its final station.

Referring, specifically, to FIG. 3, the finger walker represents a very specialized piece of equipment being carried to a final station by the structure embodying the present invention. Although a secondary function of the embodiment, the finger walker must be moved radially and laterally in order to be carried into precise register with the overhead tube holes. FIG. 4 discloses the finger walker inserted into the overhead tube holes at the final station. To make this registration, the embodiment of the invention articulates the bracket on which the finger walker rests laterally. The structure of the embodiment to carry out this articulation will be subsequently disclosed in relation to FIG. 5.

In the actual reduction to practice of the invention, the finger walker may be thrust into the vessel through one of two manways. The scope of the invention is not affected by which manway is utilized. The invention is embodied in structure which is mounted at any manway provided, and the extensible arm carries the finger walker into the hostile environment within the vessel and is articulated manually to register the finger walker with its final station. Only the hands and arms of personnel need be thrust within the manway to articulate the structure embodying the present invention.

Form and Cooperation of Assembly

Referring to FIGS. 1–4, wall 1 is disclosed as the massive shell of a vessel having an access opening 2 from which the cover has been removed so that the embodying structure of the invention may be mounted on wall 1 and extend through access opening 2. The base of the articulated assembly is a framework which is represented in all of the figures by bracket 3.

It must be understood that bracket 3 is part of a framework which includes a duplicate of bracket 3, spaced therefrom to saddle the remainder of the assembly embodying the invention. For clarity, only bracket 3 is disclosed, bracket 3 being clearly shown in only FIGS. 1–4 as bolted to external holes at the top of opening 2. Bolt 4 represents the bolts necessary to firmly secure the framework of bracket 3 in the position illustrated in FIGS. 1–4. In the actual reduction to practice, two bolts, one of which is shown in the figures, were found to adequately secure bracket 3 in the position shown. The framework of bracket 3 supports the entire assembly of parts at point 5. Point 5 is the location of the pivot for the assembly making up the embodiment.

Some form of link is required to pivot at point 5 from bracket 3 and, in turn, form a mount for the rmainder of the assembly. Pivot slider assembly 7 performs this function and can be observed in its two basic positions in FIGS. 1 and 2 and FIGS. 3 and 4. In FIGS. 1 and 2, slider assembly 7 is shown in its extreme counter-clockwise position on bracket 3. In FIGS. 3 and 4, slider assembly 7 is shown in its second, or alternate, position to which it has been pivoted clockwise about pivot point 5.

The size and weight of the embodying structure of the invention does not bear upon the scope of the invention. In the actual reduction to practice, the embodying structure has a weight of about 35 pounds. The size and weight of the structure is not a factor in disclosing the invention.

Pivoting slider assembly 7 is somewhat reminiscent, in its articulation, of the common jackknife, the "blade" (slider assembly 7) being in its closed position in FIGS. 1 and 2 and in its "open" position in FIGS. 3 and 4. Mounted on the slider assembly 7 is a tubular member 10 having sliding engagement with the slider assembly through a key rail 11.

Transfer tube assembly 10 has two positions relative to slider assembly 7. The first position is disclosed in FIG. 1, being the extreme position to the right, as viewed in the drawing, which enables the finger walker to be mounted on its end in the benign environment outside the wall 1. The second position of transfer tube 10 relative to slider assembly 7 is disclosed in FIG. 2. In transition between FIG. 1 and FIG. 2, transfer tube 10 is moved toward the hostile environment on the other side of wall 1 through its connection with slider assembly 7 by key rail 1. In the forward position of the transfer tube 10 disclosed in FIG. 2, locking knob 12 fixes the relationship between tube 10, rail 11, and slider assembly 7. Thereafter, these three parts are pivoted clockwise into the position of FIG. 3, transporting the finger walker assembly 13 through the opening 2, ready for elevation to its ultimate station.

Not only is transfer tube 10 shifted forward on slider assembly 7, but the position of finger walker 13, on its carriage 14, is shifted forward far enough to avoid interference with the edge of the access opening 2. With both transfer tube 10 and finger walker 13 shifted forward, the pivoting takes place about point 5 to arrive at the sequence of FIG. 3. FIG. 3 shows the assembly with the finger walker 13 mounted thereon in position within the hostile environment. The finger walker can be laterally and radially moved about transfer tube 10 to align with its ultimate station to which it is to be elevated. This alignment of the finger walker can, of course, be accomplished by the hands and arms of the operator extended through the access opening 2.

Elevation of the finger walker is readily disclosed by comparison between FIGS. 3 and 4. The carriage 14 is arranged to slide the length of tube 10. The position of carriage 14 is vertically controlled by its attachment to chain 15 which is led over sprockets 16 and 17. The rotation of the sprockets 16 and 17 by a reversible motor 18 is disclosed in FIG. 5. Motor 18, in the actual reduction to practice, was a DC, low-speed, high-torque type, as well as reversible.

The Exploded View of FIG. 5

FIG. 5 discloses many pertinent features of the inventive embodiment to further advantage. The companion of bracket 3 can now be discerned as part of the framework which straddles slider assembly 7 and transfer tube assembly 10 to provide the pivot 5. Additionally, transfer tube assembly 10, through its key rail 11, slides in its relationship to slider assembly 7 and is locked thereto through locking knob 12. Spring-loaded plunger **12*a* holds assembly 7 in either the horizontal (counterclockwise), or vertical (clockwise) positions shown in FIGS. 1 and 3**, respectively.

The most important elaboration on the disclosure is bracket, or carriage, 14. Carriage 14 is so termed to connotate its function in traveling the length of transfer tube 10. Also, carriage 14 can be moved around tube 10 so that finger walker 13, carried thereon, is radially positioned to register with its ultimate station. Suitable brackets, holders, and supporters between 14 and 13 are arranged so that personnel can hook, or mount, finger walker 13 on carriage 14 while the finger walker is laterally positioned and, finally, elevated to its ultimate station. When 13 is positioned in the tube sheet, 14 can be detached from 13 by simply reversing the direction of the chain drive.

The elevation of the carriage-finger walker is controlled through chain 15. As previously explained, chain 15 passes over sprockets 16 and 17. In turn, sprocket 17 is turned by motor 18, moving the carriage-finger walker vertically along transfer tube 10.

Sprockets 16 and 17 are specifically mounted on the ends of tube 20 which is concentrically arranged within transfer tube 10. These two tubes are connected to each other through bearings 21 and 22, tube 20 extending beyond the ends of transfer tube 10 to support the sprockets and motor. This structural arrangement enables tube 20 to be rotated relative to tube 10 and, thereby, radially move finger walker 13 into its proper registration with its ultimate station.

Of course, FIG. 5 discloses the transfer tube 10 within the framework of bracket 3, as disclosed in FIGS. 1 and 2. It is after transfer tube 10 has been moved forward and locked by locking knob 12 that the tube is jackknifed clockwise about pivot 5 into the FIGS. 3 and 4 positions and held in position by **12*a***.

Conclusion

In broad brush strokes, guided by the four steps of articulation dramatized in FIGS. 1–4, the operation of the assembly embodying the present invention is apparent. The assembly is moved into the FIG. 1 position and bolted securely to the vessel whose interior is to be invaded by finger walker 13. The finger walker 13 is mounted on carriage 14, while the external end of transfer tube 10 is safely lodged in the benign environment in which personnel can make the attachment.

The gun is then loaded by shoving transfer tube 10 toward the vessel interior on key rail 11. See FIG. 2.

Additionally, finger walker 13, on its carriage 14, is powered forward to avoid contact with the edge of opening 2. All is then in readiness to pivot the assembly into the vessel through opening 2. Whatever force is needed to applied to the external end of tube 10 to pivot 10, 11 and 7 about pivot point 5. This movement to the FIG. 3 position whisks carriage 14 and its finger walker 13 burden into the vessel. Plunger 12*a* holds assembly 7 in the vertical position.

The climax is reached by the elevation of carriage 14, through the chain 15 and sprockets 16, 17 linkage with motor 18, to the station disclosed in FIG. 4. Whether a finger walker, or other device, is to be moved to its ultimate station, the invention, as embodied, has completed the transition. Specifically, as disclosed in FIG. 4, the finger walker is moved to its ultimate station on tube sheet 25. Within tube sheet 25 are tube holes 26. The invention lodges finger walker 13 within these tube holes 26 and leaves it there for its subsequent function of inspection and removal of defective tubes from service by lowering 14.

From the foregoing, it will be seen that this invention is one well adapted to attain all of the ends and objects hereinabove set forth, together with other advantages which are obvious and inherent to the apparatus.

It will be understood that certain features and subcombinations are of utility and may be employed without reference to other features and subcombinations. This is contemplated by and is within the scope of the invention.

As many possible embodiments may be made of the invention without departing from the scope thereof, it is to be understood that all matter herein set forth or shown in the accompanying drawings is to be interpreted in an illustrative and not in a limiting sense.

The invention having been described, what is claimed is:

1. An apparatus with which to transport a unit from a first environment to a second environment, including, a vessel having a wall as a boundary between a hostile environment within the vessel and a benign environment outside the vessel, an access opening through the wall of the vessel, a support framework mounted on the wall from the benign environment outside the vessel and extensible through the access opening and into the vessel interior, a pivot structure mounted on that portion of the framework extended into the hostile environment within the vessel, a slider assembly supported at the pivot structure so that it may be pivoted from outside the vessel to within the vessel through the access opening, an elongated tubular structure mounted on the slider assembly in the arrangement which will permit the tubular structure to longitudinally shift relative to the slider assembly toward and away from the vessel interior, a carriage structure mounted in sliding engagement with the tubular structure, means for shifting the carriage to the upper end of the tubular member, a unit mounted on the carriage as the tubular structure extends into the benign environment outside the vessel, and means for pivoting the slider assembly and tubular structure through the access opening and into the vessel interior and establish the tubular member in an upright position, whereby the unit is carried to a desired position within the vessel as the carriage is shifted to the upper end of the tubular member.

2. The apparatus of claim 1, wherein, the means for shifting the carriage includes a chain connected to the carriage and sprockets which are mounted at each end of the tubular member over which the chain is arranged, and motive means connected to the sprockets and chain to rotate the sprockets and thereby move the attached carriage between one end and the other of the tubular member.

3. The apparatus of claim 1, wherein, a key rail member is mounted on the tubular member and engages the slider assembly to guide the shift of the tubular member in relation to the slider assembly, and locking means between the key rail and the slider assembly to lock the tubular member in its extreme position toward the vessel interior.

4. An extensible structure adapted to mount equipment in a hostile environment, including, a first hostile environment;

a wall containing the hostile environment;

an access opening in the wall; and the extensible structure adapted to be mounted on the wall and at the access opening, including, a bracket structure bolted to the wall at the access opening and extending through the opening to the hostile environment, pivot structure on the bracket within the hostile environment, a slider assembly supported at the pivot structure and extending through the access opening when rotated to its extreme clockwise position, a first tubular structure slidingly mounted on the slider assembly and arranged to extend through the access opening and into the hostile environment from outside the wall, a carriage member mounted to slide the length of the first tubular structure, a second tubular structure within the first tubular structure, sprockets mounted at each end of the second tubular structure at a location beyond the end of the first tubular structure, a chain connected to the carriage member and led over the sprockets, a reversible motor connected to one of the sprockets with which the carriage is powered the length of the first tubular structure, and equipment mounted on the carriage member which is to be positioned at a station within the hostile environment, whereby the slider assembly and tubular structures and carriage are pivoted from the bracket into the hostile environment for subsequent placement of the equipment on the carriage at its final station.

5. The extensible structure of claim 4, including, bearings connecting the first and second tubular structures to enable the second tubular structure to be rotated within the first tubular structure to provide radial movement of the equipment mounted on the carriage to carry out precise registration of the equipment to the station to which the equipment is elevated by the reversible motor.

6. The extensible structure of claim 4, in which, the first tubular structure is mounted on the slider assembly through a key rail, and a locking structure between the key rail and the slider assembly fixes the relative positions of the slider assembly and tubular structure prior to pivoting the slider assembly to carry the carriage and equipment mounted thereon into the hostile environment.

* * * * *